US005562087A

United States Patent [19]

Wright

[11] Patent Number: 5,562,087

[45] Date of Patent: Oct. 8, 1996

[54] OIL SEPARATOR FOR BLOW-BY GASES

[76] Inventor: Richard T. Wright, 7145 Edgebrook La., Hanover Park, Ill. 60103

[21] Appl. No.: 544,266

[22] Filed: Oct. 17, 1995

[51] Int. Cl.[6] ..... F02B 25/06

[52] U.S. Cl. ..... 123/372

[58] Field of Search ..... 123/572, 573, 123/574, 41.8

[56] References Cited

U.S. PATENT DOCUMENTS

| | | | |
|---|---|---|---|
| 4,409,950 | 10/1983 | Goldberg | 123/572 |
| 4,627,406 | 12/1986 | Namiki et al. . | |
| 5,201,301 | 4/1993 | Re | 123/574 |
| 5,243,950 | 9/1993 | Dalupan | 123/572 |
| 5,487,371 | 1/1996 | Beckman et al. | 123/572 |

*Primary Examiner*—Marguerite McMahon
*Attorney, Agent, or Firm*—Mason, Kolehmainen, Rathburn & Wyss

[57] ABSTRACT

An oil separator for blow-by gases formed in internal combustion engines includes a nozzle that has a plurality of holes located in the air flow path of the blow-by gases. The diameter of the holes and the thickness of the nozzle results in the flow of blow-by gases being accelerated as the gases flow through the nozzle so that small droplets of oil in the blow-by gases tend to be formed into fewer and larger oil droplets. A portion of the oil droplets will coalesce on the outer surface of the nozzle and drain to an oil drain. The remainder of the accelerated blow-by gas flows through an air gap adjacent the outer surface of the nozzle onto an impervious impingement plate or surface. At least a substantial portion of the remaining oil droplets in the blow-by gases will coalesce on the impingement surface and flow along the impingement surface to the oil drain for reintroduction into the oil reservoir of the engine. The cleansed blow-by gases then flow out of the oil separator through an outlet. The nozzle and the impingement surface can be generally flat plates or have a generally right cylindrical shape. In at least one embodiment of the present invention, the blow-by gases flow through a circuitous path after impinging on the impingement surface to further extract oil from the gases.

17 Claims, 3 Drawing Sheets

OIL SEPARATOR FOR BLOW-BY GASES

BACKGROUND OF THE INVENTION

1. Field of the Invention

The present invention relates generally to an oil separator for blow-by gases that need to be vented from a crankcase of an internal combustion engine and more particularly, to a new and improved oil separator for oil laden blow-by gases that utilizes a nozzle having a plurality of holes to direct the flow of such gases against an impingement plate or wall so as to extract oil from the crankcase blow-by gases.

2. Background of the Invention

In an internal combustion engine, the crankcase needs to be vented due to the flow of gases from the combustion chambers past the piston rings into the crankcase. The gases flowing from the combustion chambers are typically referred to as blow-by gases. The high gas velocities resulting from the movement of the pistons cause oil droplets to be carried with the blow-by gases into the crankcase and as a result into the crankcase ventilation system. In the case of passenger automobiles, these blow-by gases are recirculated through a PCV (Positive Crankcase Ventilation) system back into the combustion chambers via the air intake system of the engine. This type of recirculation of the blow-by gases is sometimes referred to as a closed system. The oil droplets in the blow-by gases are in a mist state and will tend to cause problems within the engine control mechanisms if recycled back into the engine. On the other hand, diesel engines used in trucks have open crankcase ventilation systems wherein the crankcase is ventilated to the atmosphere. This is sometimes accomplished by a road draft tube that extends downwardly from the truck engine so that the blow-by gases from the crankcase laden with oil are expelled onto the roadway.

The open diesel truck ventilation system has the advantage that the oil laden blow-by gases are not recirculated back into the engine where they can cause problems to the proper operation of the engine. However, the oil laden air in such an open system is spilled onto roadways which is not environmentally desirable and may be contrary to future EPA standards. In order to separate the oil from the blow-by gases prior to being expelled from the road draft tubes, a variety of oil separators have been used. One such oil separator used in diesel engines for trucks is commonly known as a gimp. A gimp includes a stainless steel wire filter that is placed in the air flow path of the blow-by gases in the crankcase. The oil particles in the blow-by gases coalesce onto the steel wire and drips back into the engine oil reservoir such that the blow-by gases that are ventilated from the crankcase have a decreased oil content. Such gimps do not produce the desired amount of oil separation from the blow-by gases and can become clogged so as to inhibit the venting of the crankcase by inhibiting the flow of the blow-by gases. Moreover, the crankcase pressures found in diesel truck engines can be so significant that as the oil collects on the steel wires of the gimps the oil will be literally blown through the gimp and reintroduced into the blow-by gases that are being vented through the road draft tube onto the roadway.

U.S. Pat. No. 4,627,406 discloses another form of an oil separator for recycled blow-by gas. The disclosed separator utilizes a pair of perforated plates with filter plates located downstream of each of the plates. Each of the plates has a set of perforations, but the sets are not in alignment and thus do not present the type of air flow path that is desirable for blow-by gases being expelled from high compression diesel engines. Moreover, the filter plates are in the path of the blow-by gases and thus present the same problems associated with gimps when they are disposed in the air flow path of the blow-by gases.

SUMMARY OF THE INVENTION

Accordingly, it is an object of the present invention to provide a new and improved oil separator for internal combustion engines that separates oil from blow-by gases.

Another object of the present invention is to provide a new and improved oil separator for internal combustion engines that utilizes a nozzle to direct the flow of such gases against an impingement plate or wall to extract oil from the crankcase blow-by gases.

A further object of the present invention is to provide a new and improved oil separator for internal combustion engines that utilizes a nozzle having a plurality of holes designed to partially extract some of the oil content from the blow-by gases and to direct the flow of such gases against an impingement plate or wall to extract a substantial portion of the remaining oil from the crankcase blow-by gases.

Still another object of the present invention is to provide a new and improved oil separator for internal combustion engines that does not require the blow-by gases to flow through a gimp or other filter material so that the oil separator can be used in engines without causing excess back pressures.

In accordance with these and many other objects of the present invention, an oil separator for blow-by gases formed in internal combustion engines includes a nozzle that has a plurality of holes located in the air flow path of the blow-by gases. The diameter of the holes and the thickness of the nozzle results in the flow of blow-by gases being accelerated as the gases flow through the nozzle so that small droplets of oil in the blow-by gases tend to be formed into fewer and larger oil droplets. A portion of the oil droplets will coalesce on the outer surface of the nozzle and drain to an oil drain. The remainder of the accelerated blow-by gas flows through an air gap adjacent the outer surface of the nozzle onto an impingement plate or surface. At least a substantial portion of the remaining oil droplets in the blow-by gases will coalesce on the impingement surface and flow along the impingement surface to the oil drain for reintroduction into the oil reservoir of the engine. The cleansed blow-by gases then are allowed to flow out of the oil separator to a road tube (open system) or to an air intake of the engine (closed system).

In one embodiment of the present invention, the nozzle is a generally flat plate disposed in the air flow path of the blow-by gases. The nozzle plate has a plurality of holes through which the blow-by gases flow onto an impingement plate mounted in spaced, generally parallel relationship to the nozzle plate. The cleansed blow-by gases then flow through a circuitous path to an outlet. In another embodiment, the nozzle is formed in a generally right cylindrical shape with the plurality of holes disposed through the outer circumferential side walls of the nozzle. The blow-by gases are introduced through the top of the nozzle and flow outwardly through the holes so as to be forced against an impingement wall surrounding the outer circumferential wall of the nozzle. Oil separated from the blow-by gases as the gases exit the nozzle and when it strikes the impingement plate drain to an oil drain at the bottom of the oil separator. The cleansed blow-by gases flow up along the impingement wall and out a channel formed between the impingement plate and an outer housing of the oil separator. In yet another embodiment, oil laden blow-by gases are injected into the bottom of a right cylindrical shaped nozzle. The blow-by gases exist through holes in the outer circumferential side walls of the nozzle onto an impingement surface that is spaced apart and surrounds the nozzle. The separated oil drains through a drain opening in the base of the oil separator. The cleansed blow-by gases flow through an outlet in the top of the oil separator.

The size and quantity of holes in and the thickness of the nozzle walls through which the holes extend and the distance of the gap between the impingement surface and the nozzle outer wall are factors in determining the amount of oil that is extracted from the blow-by gases while providing a sufficient air flow path for the blow-by gases so that an undesirable back pressure does not result from the oil separator. For example, the nozzles can be approximately 0.69 inches thick and include fifty holes of approximately 0.113 inches diameter with the gap between the nozzle and the impingement surface being about 0.250 inches.

BRIEF DESCRIPTION OF THE DRAWINGS

Many other objects and advantages of the present invention will become apparent from considering the following detailed description of the embodiments of the invention illustrated in the drawings, wherein.

DETAILED DESCRIPTION OF THE PREFERRED EMBODIMENTS

Figure 1:
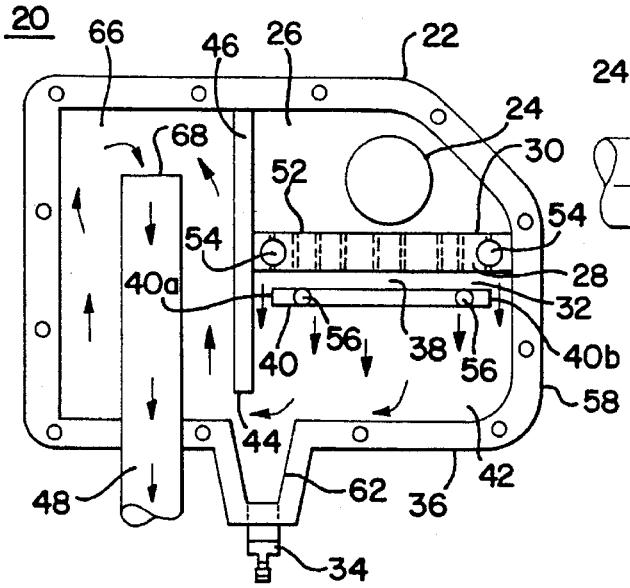
FIG. 1 is a front elevational view of an oil separator embodying the present invention with the cover removed.

Referring now more specifically to FIGS. 1–5 of the drawings, therein is disclosed an oil separator for an internal combustion engine generally designated by the reference numeral 20 and embodying the present invention. The oil separator 20 includes an outer housing 22 with an air inlet 24 into an inlet chamber 26 within the housing 22, at the lower end of which is a nozzle 28. Oil laden blow-by gases from a crankcase of an internal combustion engine (for example, a diesel engine (not shown)) are introduced into the inlet chamber 26 through the air inlet 24 so that the blow-by gases flow through holes 30 in the nozzle 28. As the blow-by gases flow through the holes 30, the velocity of the blow-by gases increase and small droplets of oil in the blow-by gases will tend to be formed into fewer and larger oil droplets. A portion of these oil droplets in the blow-by gases will coalesce on a lower outer surface 32 of the nozzle 28 and drain to an oil drain fitting 34 in a bottom wall 36 of the housing 22. The remainder of the oil droplets will flow with the accelerated blow-by gas through an air gap 38 onto an impingement plate 40 disposed generally parallel to the nozzle 28 but spaced apart by the air gap 38. Upon impinging on the impingement plate 40, at least a substantial portion of the remaining oil droplets in the blow-by gases will coalesce onto the impingement plate 40 and drain around the plate 40 to the oil drain fitting 34. The cleansed blow-by gases will flow about side edges of the impingement plate 40, through a lower chamber 42 in the housing 22, around a lower edge 44 of a separating wall 46, and out of an outlet 48. The cleansed blow-by gases flowing through the outlet 48 can be expelled through a road tube connected to the outlet 48 in the case of an open system or recycled back into the air intake of the internal combustion engine in the case of a closed system.

The housing 22 for the oil separator 20 may be made of high temperature resistant plastic or alternatively can be made of metal such as die cast aluminum. The air inlet 24 extends through an outer back wall 50 of the housing 22 into the upper, inlet chamber 26. The air inlet 24 is adapted to be connected to the crankcase of an internal combustion engine so that blow-by gases in the crankcase are permitted to be vented from the crankcase into the inlet chamber 26. As is discussed above, these blow-by gases tend to contain a considerable amount of oil in mist or particle form. The pressure within the crankcase causes the blow-by gases to flow through the nozzle 28 and more particularly the holes 30 in the nozzle 28.

Figure 5:
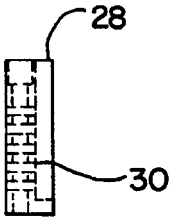
FIG. 5 is a side elevational view of the impingement plate disclosed in FIG. 4.
Figure 4:
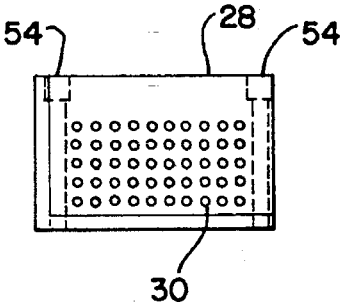
FIG. 4 is a top elevational view of the impingement plate used in the oil separator illustrated in FIG. 1.

As is in part illustrated in FIGS. 4–5, the nozzle 28 is a generally rectangular shaped plate with the series of holes 30 extending through the nozzle plate 28. The preferred embodiment of the nozzle 28 shown in the drawings can be made of high temperature resistant plastic or alternatively can be made of metal such as die cast aluminum that is approximately 0.69 inches thick from a top side 52 to the bottom side 32 and includes five rows of ten holes each for a total of fifty holes 30. The holes 30 are disposed in the nozzle 28 so that the center-line to center-line spacing is approximately 0.254 inches and the diameter of each of the holes 30 is approximately 0.113 inches. The nozzle 28 additionally includes mounting holes 54 along its outer edges for mounting by fasteners (not shown) the nozzle 28 in the housing 22.

The actual sizes of the holes 30 and the number of holes 30 in the nozzle 28 will be in part dependent on the horsepower generated by the engine from which the blow-by gases are being vented. However, the holes 30 need to be of such a size and number as to cause the velocity of the blow-by gases flowing through the holes 30 to be increased so that small droplets of oil in the blow-by gases will be formed into fewer and larger oil droplets. On the other hand, the overall cross sectional area of the holes 30 has to be sufficient as to not cause any excessive back pressure for the blow-by gases flowing through the oil separator 20.

Figure 2:
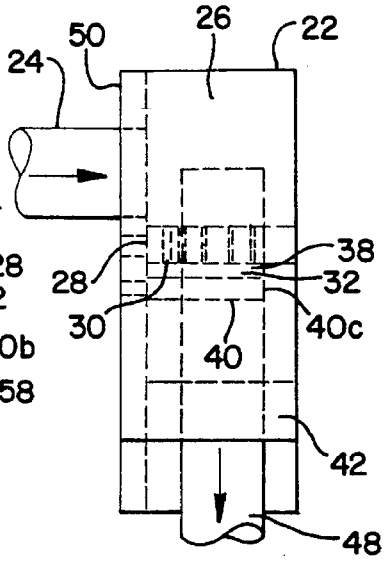
FIG. 2 is a side view of the oil separator of FIG. 1.
Figure 3:
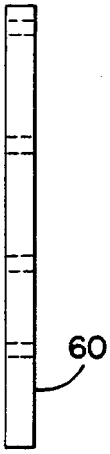
FIG. 3 is a side elevational view of the cover that encloses the oil separator illustrated in FIG. 1.

The impingement plate 40 is positioned below the lower surface 32 of the nozzle 28 such that the air gap 38 is formed between the nozzle 28 and the impingement plate 40. The impingement plate 40 can be made of high temperature resistant plastic or alternatively can be made of metal such as die cast aluminum so as to be generally impervious to gases impinging on it and includes mounting holes 56 for fasteners (not shown) to secure the impingement plate 40 in the housing 22 just below the nozzle 28. As is illustrated in FIGS. 1–2, the impingement plate 40 is not as wide as the housing 22 from the dividing wall 46 to an outer housing wall 58. Likewise, the impingement plate 40 extends from the back wall 50 toward a front cover 60 (FIG. 3) that encloses the front portion of the housing 22 and provides access into the housing 22. The impingement plate 40 does not extend to the cover 60 so that air flow passages are provided about side edges 40*a* and 40*b* as well as front edge 40*c* of the impingement plate 40.

The bottom wall 36 of the housing 22 includes a frustroconical shaped recess 62 for receiving oil that is separated from the blow-by gases in the oil separator 20. The oil drain fitting 34 is disposed at the basin of the recess 62 so that the oil received in the recess 62 can be circulated back to the oil reservoir of the engine by connecting a tube or the like to the fitting 34. The bottom wall 36 additionally includes an access opening for the outlet 48. As is shown in FIGS. 1–2, the outlet 48 extends upwardly from the bottom wall 36 into an outlet chamber 66 formed by the separating wall 46. The positioning of the outlet 48 with respect to the bottom edge 44 of the separating wall 46 and the positioning of the impingement plate 40 below the nozzle 28 forces the blow-by gases to flow in a circuitous path after flowing through the holes 30 in the nozzle 28.

More specifically and as shown by the arrows in FIG. 1, the blow-by gases flow out from the holes 30 in the nozzle 28 and strike the impingement plate 40. As is discussed above, a substantial amount of the oil contained in the blow-by gases that are introduced into the oil separator 20 through the inlet 24 will be so extracted from the gases. The blow-by gases then flow about the edges 40*a*, 40*b*, and 40*c* of the impingement plate 40 into the lower chamber 42, about the lower edge 44 of the separating wall 46 and upperwardly into an upper end 68 of the outlet 48. Accordingly, the blow-by gases are forced to flow in the circuitous path indicated by the arrows in FIGS. 1 and 2 resulting in further extraction of oil that still might be remaining in the blow-by gases after flowing about the impingement plate 40. Any such extracted oil can likewise drain into the oil recess 62.

Figure 6:
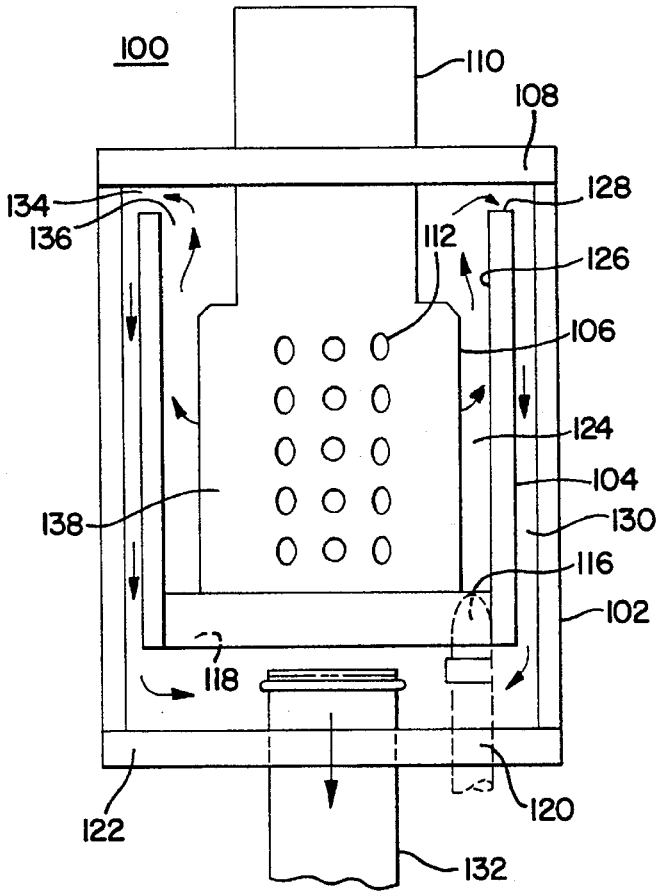
FIG. 6 is a side view of an alternate embodiment of an oil separator embodying the present invention.
Figure 7:
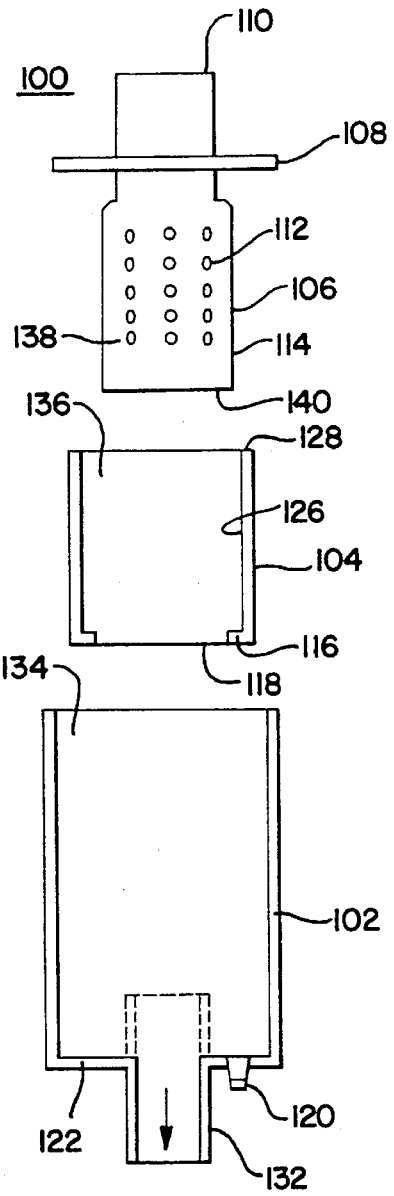
FIG. 7 is an explode perspective view of the oil separator of FIG. 6.

Another embodiment of the present invention is disclosed in FIGS. 6–7 wherein an oil separator for an internal combustion engine is illustrated that is generally designated by the reference numeral 100 and embodies the present invention. The oil separator 100 includes an outer shell 102, an impingement wall insert 104, a nozzle 106 and an upper closure 108. Oil laden blow-by gases from a crankcase of an internal combustion engine (for example, a diesel engine (not shown)) are introduced through a top air inlet 110 that forms the top portion of the nozzle 106. The blow-by gases flow through holes 112 extending through an outer circumferential wall 114 of the nozzle 106. As the blow-by gases flow through the holes 112, the velocity of the blow-by gases increase and small droplets of oil in the blow-by gases will tend to be formed into fewer and larger oil droplets. A portion of these oil droplets in the blow-by gases will coalesce on the outer wall 114 of the nozzle 106 and drain downwardly through an oil drain opening 116 in a bottom wall 118 of the impingement wall insert 104 into an oil return fitting 120 in a bottom wall 122 of the outer shell 102.

The remainder of the oil droplets will flow with the accelerated blow-by gas through an air gap 124 onto a circumferential outer wall 126 of the impingement wall insert 104. Upon impinging on the impingement wall 126, at least a substantial portion of the remaining oil droplets in the blow-by gases will coalesce onto the impingement wall 126 and drain along the impingement wall 126 to the oil drain opening 116 and thereby to the oil return fitting 120. The cleansed blow-by gases will flow upward along the impingement wall 126, around an upper edge 128 of the impingement wall 124, along an air gap 130 between the impingement wall 124 and the outer shell 102 to an outlet 132 disposed through the bottom wall 122 of the outer shell 102. The cleansed blow-by gases flowing through the outlet 132 can be expelled through a road tube connected to the outlet 132 in the case of an open system or recycled back into the air intake of the internal combustion engine in the case of a closed system.

The outer shell 102 for the oil separator 100 may be made of high temperature resistant plastic or alternatively can be made of metal such as die cast aluminum. The outer shell 102 has a generally right cylindrical shape with an open top end 134 and the bottom wall 122 closing the bottom portion of the outer shell 102. The outlet 132 extends through the bottom wall 122 and the oil return fitting 120 also extends through the bottom wall 122 so that oil draining through the oil drain fitting 120 can be recycled into the oil reservoir of the engine.

The outer shell 102 is adapted to receive the impingement wall insert 104 through its open top end 134 so that it is affixed in the outer shell 102 as illustrated in FIG. 6 of the drawings. The impingement wall insert 104 can be made of high temperature resistant plastic or alternatively can be made of metal such as die cast aluminum so as to be impervious to gases impinging on it. The impingement wall insert 104 is similarly shaped to the outer shell 102 in that it has a generally right cylindrical shape with the bottom wall 118 closing the bottom portion of the impingement wall insert 104 except for the oil drain opening 116. The nozzle 106 is adapted to be inserted through an open top portion 136 of the impingement wall insert 104.

The nozzle 106 can be made of high temperature resistant plastic or alternatively can be made of metal such as die cast aluminum and when inserted into the impingement wall insert 104 will be positioned as shown in FIG. 6 of the drawings. The nozzle 106 has an enlarged right cylindrical air directing portion 138 and the slightly smaller in diameter right cylindrical inlet portion 110. A lower end 140 of the air directing portion 138 is open, but will be sealed by the bottom wall 118 of the impingement wall insert 104 when the nozzle 106 is fixed in the impingement wall insert 104. The air directing portion 138 has fifty holes 112 extending through the nozzle 106. These fifty holes 112 are uniformly disposed about the air directing portion 138 in ten rows of five holes each. The upper closure 108 seals the top 136 of the impingement wall insert 104 and the top 134 of the outer shell 102 when the nozzle 106 is disposed in the impingement wall insert 104.

The top air inlet 110 extends through the upper closure 108 and is adapted to be connected to the crankcase of an internal combustion engine so that blow-by gases in the crankcase are permitted to be vented from the crankcase through the inlet 110 into the air directing portion 138 of the nozzle 106. As is discussed above, these blow-by gases tend to contain a considerable amount of oil in mist or particle form. The pressure within the crankcase causes the blow-by gases to flow through the holes 112 in the nozzle 106.

The preferred embodiment of the nozzle 106 shown in the drawings can be approximately 0.69 inches thick and includes five rows of ten holes each for a total of fifty holes 112 with each hole 112 having a diameter of approximately 0.113 inches. The actual sizes of the holes 112 and the number of holes 112 in the nozzle 106 will be in part dependent on the horsepower generated by the engine from which the blow-by gases are being vented. However, the holes 112 need to be of such a size and number as to cause the velocity of the blow-by gases flowing through the holes 112 to be increased so that small droplets of oil in the blow-by gases will be formed into fewer and larger oil droplets. On the other hand, the overall cross sectional area of the holes 112 has to be sufficient as to not cause any excessive back pressure for the blow-by gases flowing through the oil separator 100.

As shown by the arrows in FIG. 6, the blow-by gases flow out from the holes 112 in the nozzle 106 and strike the impingement wall 126 that surrounds the air directing portion 138 of the nozzle 106. As is discussed above, a substantial amount of the oil contained in the blow-by gases that are introduced into the oil separator 100 through the inlet 110 will be extracted from the gases. The blow-by gases then flow about the upper edge 128 of the impingement wall 126 along the air gap 130 between the impingement wall 126 and the outer shell 102 to the outlet 132. This circuitous path that the blow-by gases are forced to flow results in further extraction of oil that still might be remaining in the blow-by gases after striking the impingement wall 126. Any such extracted oil also drains into the oil return fitting 120 for recycling back into the oil reservoir of the engine.

Figure 8:
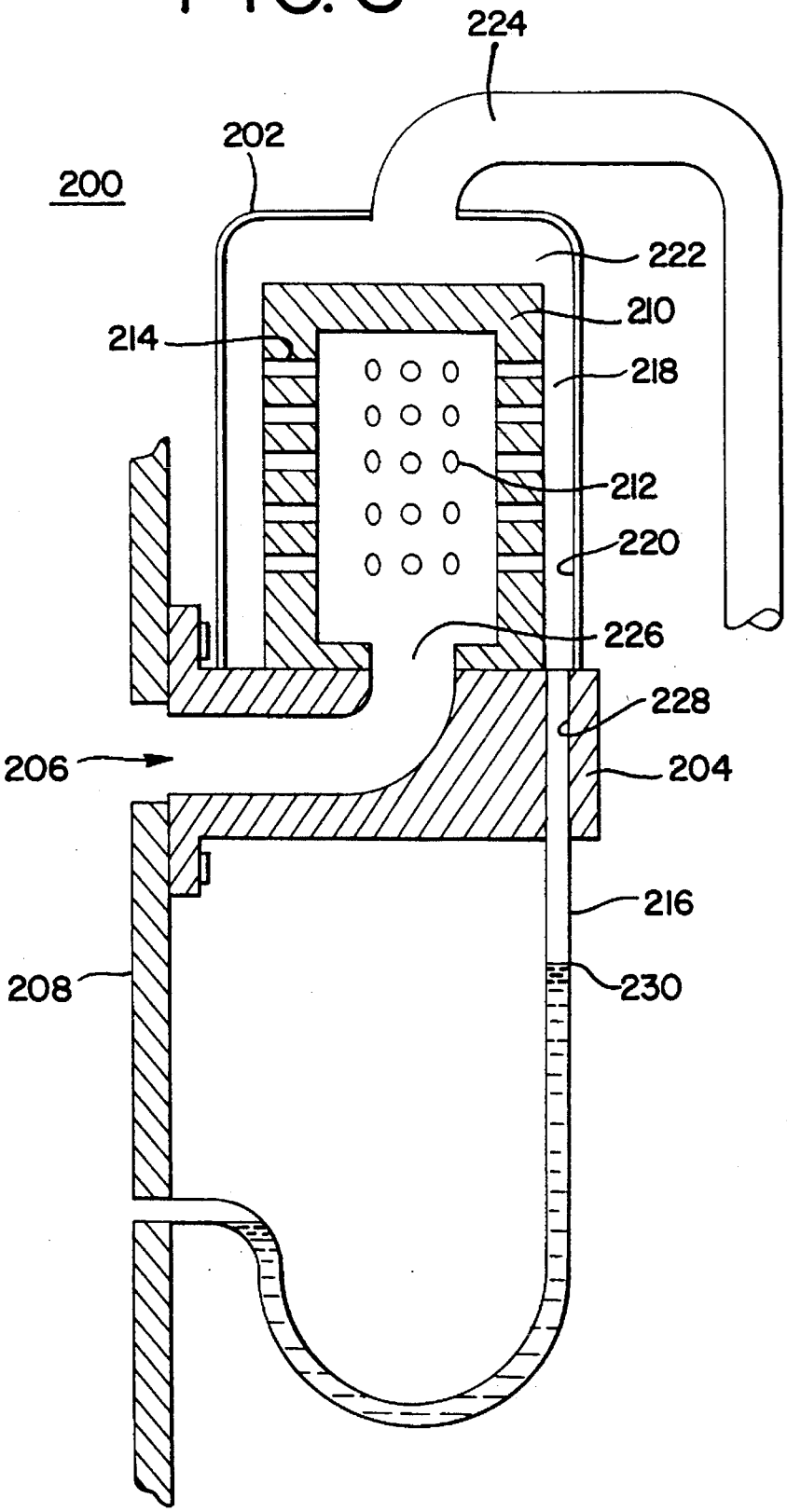
FIG. 8 is a cross sectional view of yet another alternate embodiment of an oil separator embodying the present invention.

Yet another embodiment of the present invention is disclosed in FIG. 8 wherein an oil separator for an internal combustion engine is illustrated that is generally designated by the reference numeral 200 and embodies the present invention. The oil separator 200 includes an impingement canister 202 mounted on a base 204. The base 204 provides an inlet 206 from a crankcase 208 of an internal combustion engine (for example, a diesel engine (not shown)). Oil laden blow-by gases from the crankcase 208 flow through the inlet 206 into a nozzle 210 that is mounted on the base 204. The blow-by gases flow through holes 212 extending through an outer circumferential wall 214 of the nozzle 210. As the blow-by gases flow through the holes 212, the velocity of the blow-by gases increase and small droplets of oil in the blow-by gases will tend to be formed into fewer and larger oil droplets. A portion of these oil droplets in the blow-by gases will coalesce on the outer wall 214 of the nozzle 210 and drain downwardly through the base 204 into an oil drain tube 216 extending from the base 204. The remainder of the oil droplets will flow with the accelerated blow-by gas through an air gap 218 formed about the nozzle outer wall 214 by an impervious impingement wall 220 of the impingement canister 202. Upon impinging on the impingement wall 220, at least a substantial portion of the remaining oil droplets in the blow-by gases will coalesce onto the impingement wall 220 and drain along the impingement wall 220 to the oil drain tube 216. The cleansed blow-by gases will flow upward in the air gap 218 into an exit chamber 222 at the top end of the nozzle 210 and through an outlet 224 to a road tube connected to the outlet 224 in the case of an open system or recycled back into the air intake of the internal combustion engine in the case of a closed system.

The base 204, the impingement canister 202 and the nozzle 210 of the oil separator 200 maybe made of high temperature resistant plastic or alternatively can be made of metal such as die cast aluminum. The base 204 is adapted to be mounted with respect to the crankcase 208 so that oil laden blow-by gases being vented from the crankcase 208 flow into the inlet 206. The inlet 206 extends through the base 204 so that the blow-by gases flowing into the inlet 206 from the crankcase 208 flow into a nozzle inlet 226 at the bottom end of the nozzle 210. The base additional includes a bore 228 that provides a fluid communication path between the air gap 218 and the oil drain tube 216 secured to the base 204 so that oil draining through the bore 228 can be recycled into the oil reservoir of the engine.

The nozzle 210 generally has a right cylindrical shape and is mounted on the base 204 so that the blow-by gases flowing into the inlet 206 from the crankcase 208 will flow into the nozzle inlet 226 at the bottom portion of the nozzle 210. The air flowing into the nozzle inlet 226 will be forced through the holes 212 extending through the outer wall 214 of the nozzle 210. In the disclosed embodiment, the nozzle 210 includes fifty holes 212 that are uniformly disposed about the nozzle wall 214 in ten rows of five holes each.

The preferred embodiment of the nozzle wall 214 shown in FIG. 8 can be approximately 0.69 inches thick and includes the five rows of ten holes each for a total of fifty holes 212 with each hole 212 having a diameter of approximately 0.113 inches. The actual sizes of the holes 212 and the number of holes 212 will be in part dependent on the horsepower generated by the engine from which the blow-by gases are being vented. However, the holes 212 need to be of such a size and number as to cause the velocity of the blow-by gases flowing through the holes 212 to be increased so that small droplets of oil in the blow-by gases will be formed into fewer and larger oil droplets. On the other hand, the overall cross sectional area of the holes 212 has to be sufficient as to not cause any excessive back pressure for the blow-by gases flowing through the oil separator 200.

The impingement canister 202 is correspondingly shaped to the nozzle 210 in that it has a generally right cylindrical shape with the base 204 sealing the bottom portion of the impingement canister 202 except for the inlet 206 and the oil drain bore 228. As is apparent from FIG. 8, the nozzle 210 is mounted within the impingement canister 202 such that the air gap 218 is formed between the outer wall 214 of the nozzle 210 and the impingement wall 220 of the impingement canister 202. The impingement canister 202 additionally includes the outlet 224 at its top end so that cleansed blow-by gases flowing within the air gap 218 to the exit chamber 222 are exhausted to the atmosphere or to the air intake of the engine.

As is discussed above, the blow-by gases flow out through the holes 212 in the nozzle wall 214 and strike the impingement wall 220 that surrounds the nozzle 210. A substantial portion of the oil contained in the blow-by gases that are introduced into the oil separator 200 will be extracted from the gases. This oil will flow through the bore 228 in the base 204 to the oil drain tube 216 so that the oil can be recycled back into the crankcase 208. As is shown in FIG. 8, the oil drain tube 216 has a generally J-shape. This shape of the oil drain tube 216 results in a column of oil being formed in the oil drain tube 216 to a height indicated by the reference numeral 230. This column of oil blocks any of the cleansed blow-by gases from flowing back into the crankcase 208 and thus forces any of the cleansed blow-by gases to flow out of the oil separator 200 only through the outlet 224 at the top end of the impingement canister 202.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. An-oil separator for oil laden gases comprising:

an inlet means for introducing said oil laden gases into said oil separator;

a nozzle means in fluid communication with said inlet means for directing said gases received by said inlet means, said nozzle means having a plurality of holes therethrough so that said oil laden gases flow through said holes and a portion of said oil in said gases coalesce on said nozzle means so as to be separated from said gases;

impingement means having an impervious impingement surface onto which said gases are directed by said nozzle means, said impingement surface being disposed in said oil separator in spaced apart relationship to said nozzle means such that an air gap is formed between said nozzle means and said impingement surface whereby further portions of said oil in said gases coalesce onto said impingement surface as said gases are directed across said air gap onto said impingement surface; and oil draining means disposed within said oil separator for receiving said oil separated from said gases as said gases flow through said holes in said nozzle means and flow against said impingement surface.

2. An oil separator as set forth in claim 1 wherein said nozzle means is generally planar with said plurality of holes extending from a first side of said nozzle means to a second side of said nozzle means, wherein said impingement means is generally planar and disposed in spaced apart relationship to said second side of said nozzle means so that said air gap is formed between said second side of said nozzle means and said impingement surface and wherein said gases flow through said inlet means, flow through said holes in said nozzle means from said first side to said second side such that said gas flow is accelerated, flow across said air gap and impinge on said impingement surface.

3. An oil separator as set forth in claim 2 wherein said nozzle means includes fifty holes, each of which holes having a diameter of approximately 0.113 inches and said holes have a center to center line spacing of approximately 0.254 inches.

4. An oil separator as set forth in claim 2 wherein said nozzle means has a thickness of approximately 0.69 inches from said first side to said second side.

5. An oil separator as set forth in claim 1 wherein said oil separator includes a housing having outer walls and an inner separating wall, said impingement means having side edges spaced apart from at least some of said outer walls and said inner wall so that said gases flow about said side edges after having impinged on said impingement surface.

6. An oil separator as set forth in claim 5 including outlet means for providing an exit for said gases from said oil separator after said gases have impinged on said impingement surface and have flowed about said inner separating wall, said outlet means being disposed relative to said inner separating wall and said impingement surface such that said gases flow in a circuitous path after exiting said holes in said nozzle means to further extract oil from said gases.

7. An oil separator as set forth in claim 1 including an outer housing having at least a lower wall and wherein said oil draining means includes a recess in said lower wall of said housing for receiving therein oil extracted from said gases that drains along said nozzle means and said impingement surface and includes an oil drain for permitting said oil to be removed from said oil separator.

8. An oil separator as set forth in claim 7 wherein said outer housing includes at least one open side to provide access into said housing, said open side being closed by a cover means.

9. An oil separator as set forth in claim 1 including an outer housing and wherein said impingement means includes an insert disposed within said outer housing such that an air passageway is formed between said impingement means and said outer housing and wherein said nozzle means is disposed within said impingement means so that said air gap is formed between said nozzle means and said impingement surface.

10. An oil separator as set forth in claim 9 wherein said an outer housing has a generally right cylindrical outer wall configuration, wherein said impingement means includes a generally right cylindrically shaped insert that is surrounded by said outer wall of said housing and wherein said nozzle means has a generally right cylindrical shape so that at least a portion of said nozzle means having said holes therethrough is surrounded by said impingement surface and is spaced from said impingement surface to form said air gap.

11. An oil separator as set forth in claim 10 wherein said nozzle means includes fifty holes, each of which holes having a diameter of approximately 0.113 inches and said holes have a center to center line spacing of approximately 0.254 inches.

12. An oil separator as set forth in claim 11 wherein said nozzle means is approximately 0.69 inches in thickness.

13. An oil separator as set forth in claim 10 wherein said housing has an outlet at a bottom thereof and said inlet is at the top of said housing such that gases flowing through said inlet flow through said holes in said nozzle means and against said impingement surface and thereafter a circuitous path through said air gap around a top end of said impingement means and through said air passageway to said outlet.

14. An oil separator as set forth in claim 9 wherein said impingement insert has a drain access in fluid communication with said air gap to provide a passage for said oil to flow to said oil draining means that extends through said housing.

15. An oil separator as set forth in claim 1 including a J-shaped tube coupled to said oil draining means so that a column of oil is formed therein to block flow of said gases out from said oil draining means.

16. An oil separator as set forth in claim 1 including a base portion through which said inlet means extends, said nozzle means being mounted on said base portion so that said oil laden air is introduced into a bottom portion of said nozzle means through said inlet means.

17. An oil separator as set forth in claim 16 including an outlet means extending from a top portion of said oil separator for providing an exit for said gases after said gases have impinged on said impingement surface and flow through said air gap.

* * * * *